US007407426B2

(12) United States Patent
Chen

(10) Patent No.: US 7,407,426 B2
(45) Date of Patent: Aug. 5, 2008

(54) ACTUATION DEVICE FOR TOY

(76) Inventor: Chao-Yung Chen, 9F., No. 169, Wan Ning St., Wen Shan District, Taipei (TW)

( * ) Notice: Subject to any disclaimer, the term of this patent is extended or adjusted under 35 U.S.C. 154(b) by 352 days.

(21) Appl. No.: 11/376,233

(22) Filed: Mar. 16, 2006

(65) Prior Publication Data

US 2006/0223413 A1 Oct. 5, 2006

(30) Foreign Application Priority Data

Mar. 30, 2005 (TW) ..... 94204874 U

(51) Int. Cl.
*A63H 3/20* (2006.01)
*A63H 11/14* (2006.01)

(52) U.S. Cl. ..... 446/330; 446/353; 446/358; 446/376; 40/414; 40/419

(58) Field of Classification Search ..... 446/330, 446/352–356, 358, 376; 40/411, 414, 417, 40/419; 74/435, 436
See application file for complete search history.

(56) References Cited

U.S. PATENT DOCUMENTS 2,677,215 A * 5/1954 Zalkind ..... 446/287
4,344,243 A * 8/1982 Reszka ..... 40/415
5,360,366 A * 11/1994 Lin ..... 446/134
5,755,610 A * 5/1998 Lin ..... 446/315
6,190,230 B1 * 2/2001 Hou ..... 446/355
6,200,192 B1 * 3/2001 Hou ..... 446/358
6,450,855 B1 * 9/2002 Tang ..... 446/330
6,579,143 B1 * 6/2003 Rehkemper et al. ..... 446/330
6,644,139 B2 * 11/2003 Liu ..... 74/421 A
6,663,461 B2 * 12/2003 Fong ..... 446/236
6,682,391 B2 * 1/2004 Yu ..... 446/330
6,955,581 B1 * 10/2005 Liu ..... 446/219
7,163,430 B1 * 1/2007 Lund et al. ..... 446/355
7,264,534 B2 * 9/2007 Stubenfoll ..... 446/227
7,270,590 B2 * 9/2007 Marine et al. ..... 446/377

* cited by examiner

*Primary Examiner*—Kien T. Nguyen
(74) *Attorney, Agent, or Firm*—Leong C. Lei

(57) ABSTRACT

An actuation device is provided herein to give self-acting toys more lively and appealing moves. The major characteristic of the present invention lies in that a motor is used to drive a gear assembly which in turn drives a gear on top of the gear assembly to rotate around the axle of the gear assembly. The gear therefore sequentially and periodically gets into contact with a number of eccentric gears arranged along the rotational path. These eccentric gears in turn drive their connecting rods which are connected to various parts of the self-acting toy to swing in various manners.

4 Claims, 5 Drawing Sheets

ACTUATION DEVICE FOR TOY

BACKGROUND OF THE INVENTION (a) Technical Field of the Invention

The present invention generally relates to actuation devices for self-acting toys, and more particularly to an actuation device driving multiple parts of a toy to jolt.

(b) Description of the Prior Art

Self-acting toys like action dolls are always more attractive to children than static toys are. However, the conventional engine or actuation device inside the self-acting toy is quite primitive and can only trigger one or two parts of the toy to move, and the children get bored easily and quickly only in a short while.

SUMMARY OF THE INVENTION

The primary purpose of the present invention is to provide an actuation device to give self-acting toys more lively and appealing moves. The major characteristic of the present invention lies in that a motor is used to drive a gear assembly which in turn drives a gear on top of the gear assembly to rotate around the axle of the gear assembly. The gear then sequentially and periodically gets into contact with a number of eccentric gears arranged along the rotational path. These eccentric gears in turn drive their connecting rods which are connected to various parts of the self-acting toy to swing in various manners.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
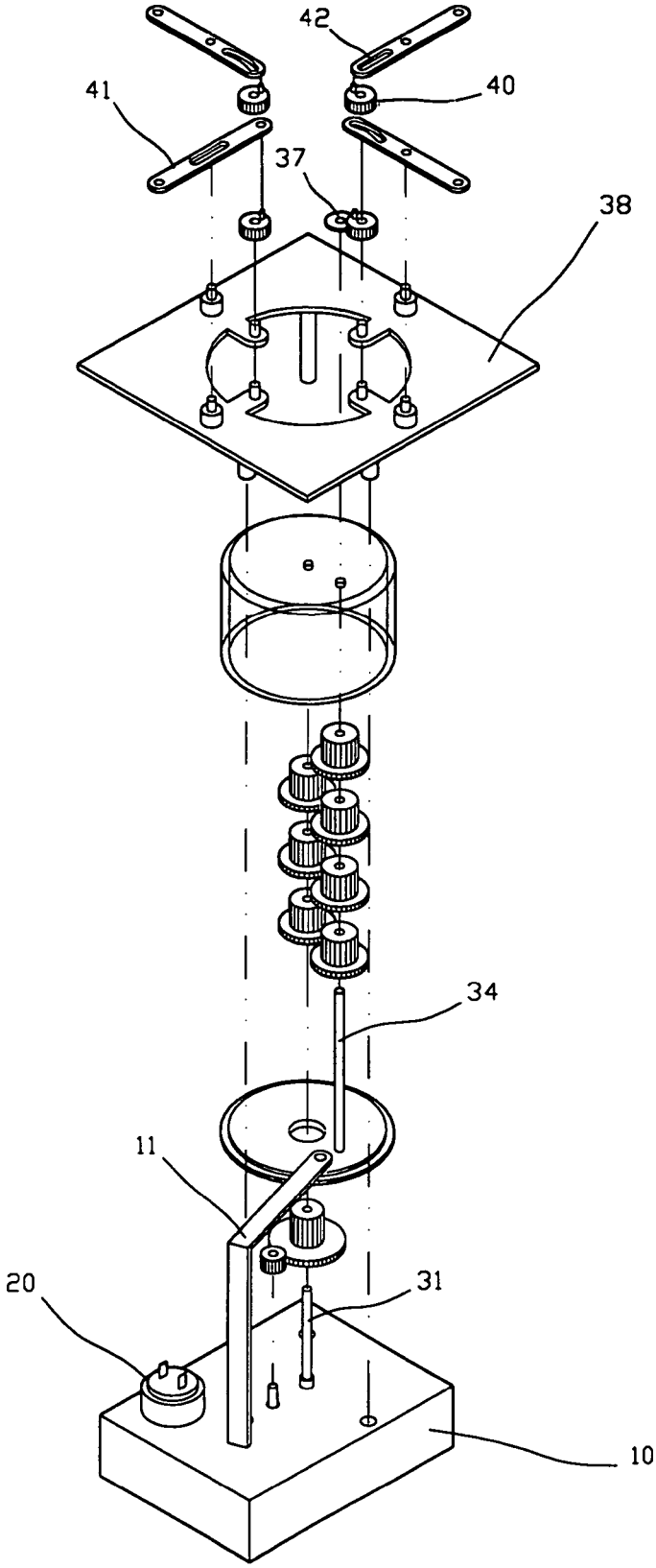
FIG. 1 is a perspective exploded view showing the actuation device according to an embodiment of the present invention.
Figure 2:
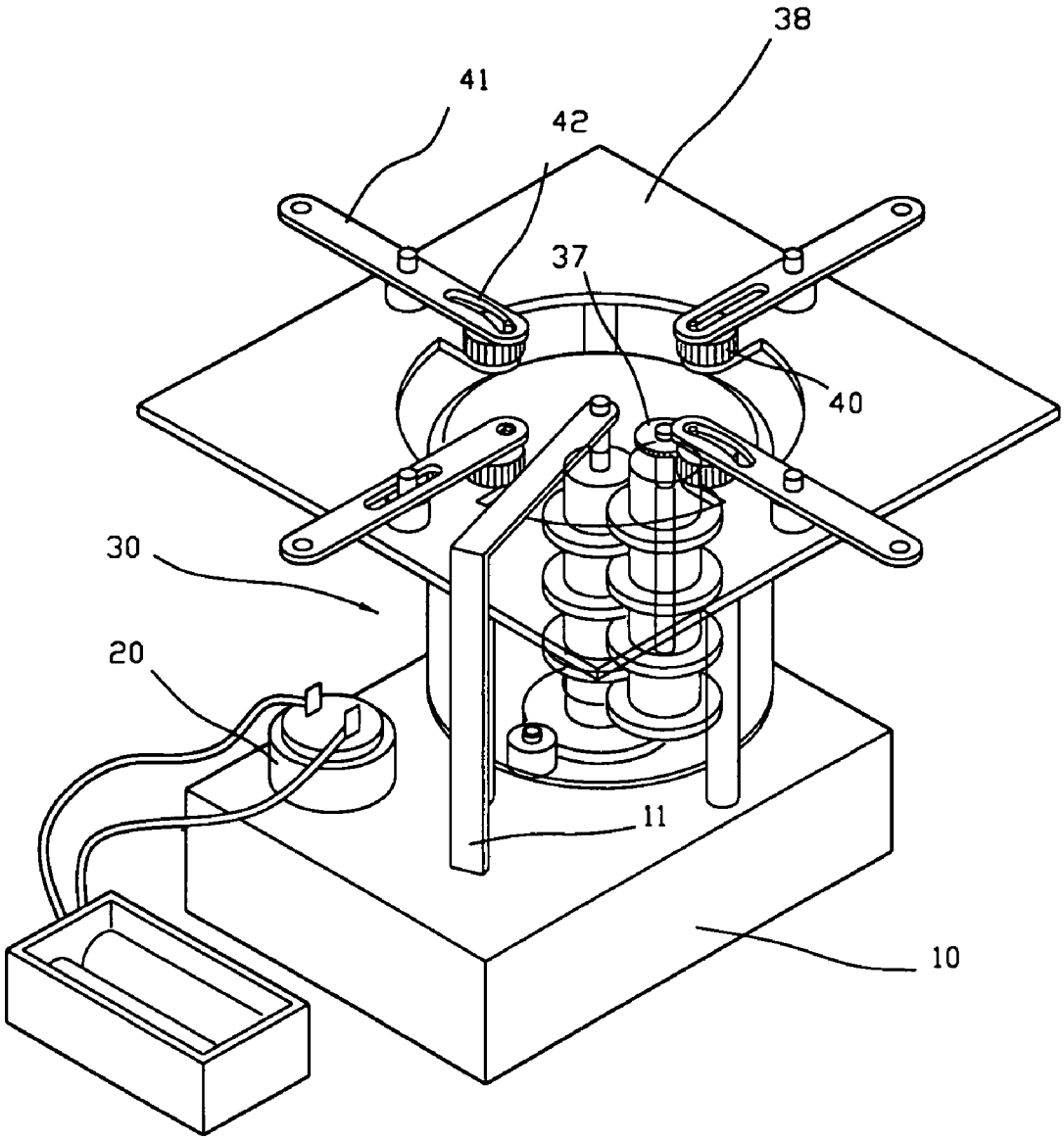
FIG. 2 is a perspective view showing the actuation device of FIG. 1.
Figure 3A:
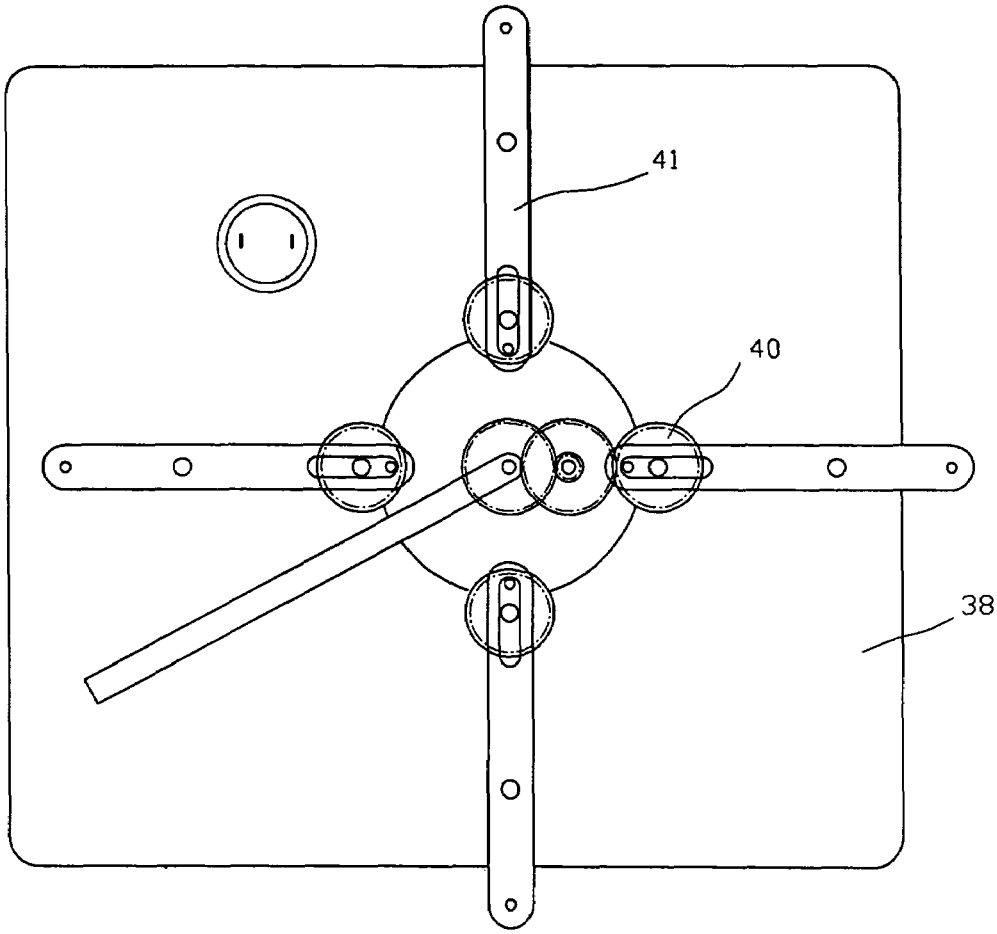
FIGS. 3A & 3B provides a top view and a sectional view of the actuation device of FIG. 1.
Figure 3B:
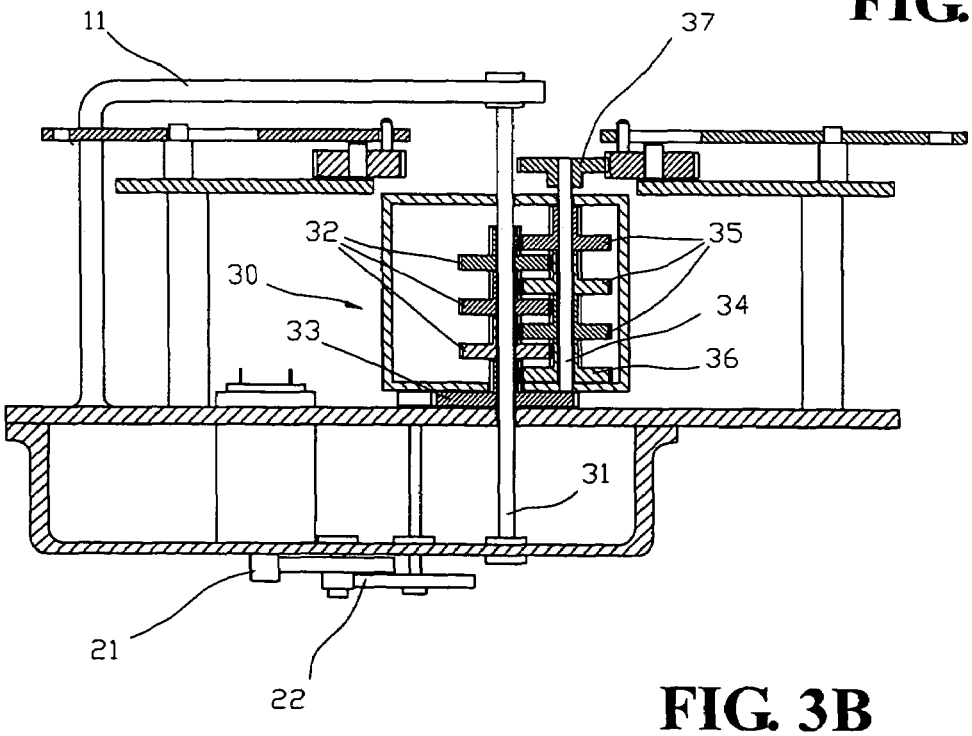
Figure 4:
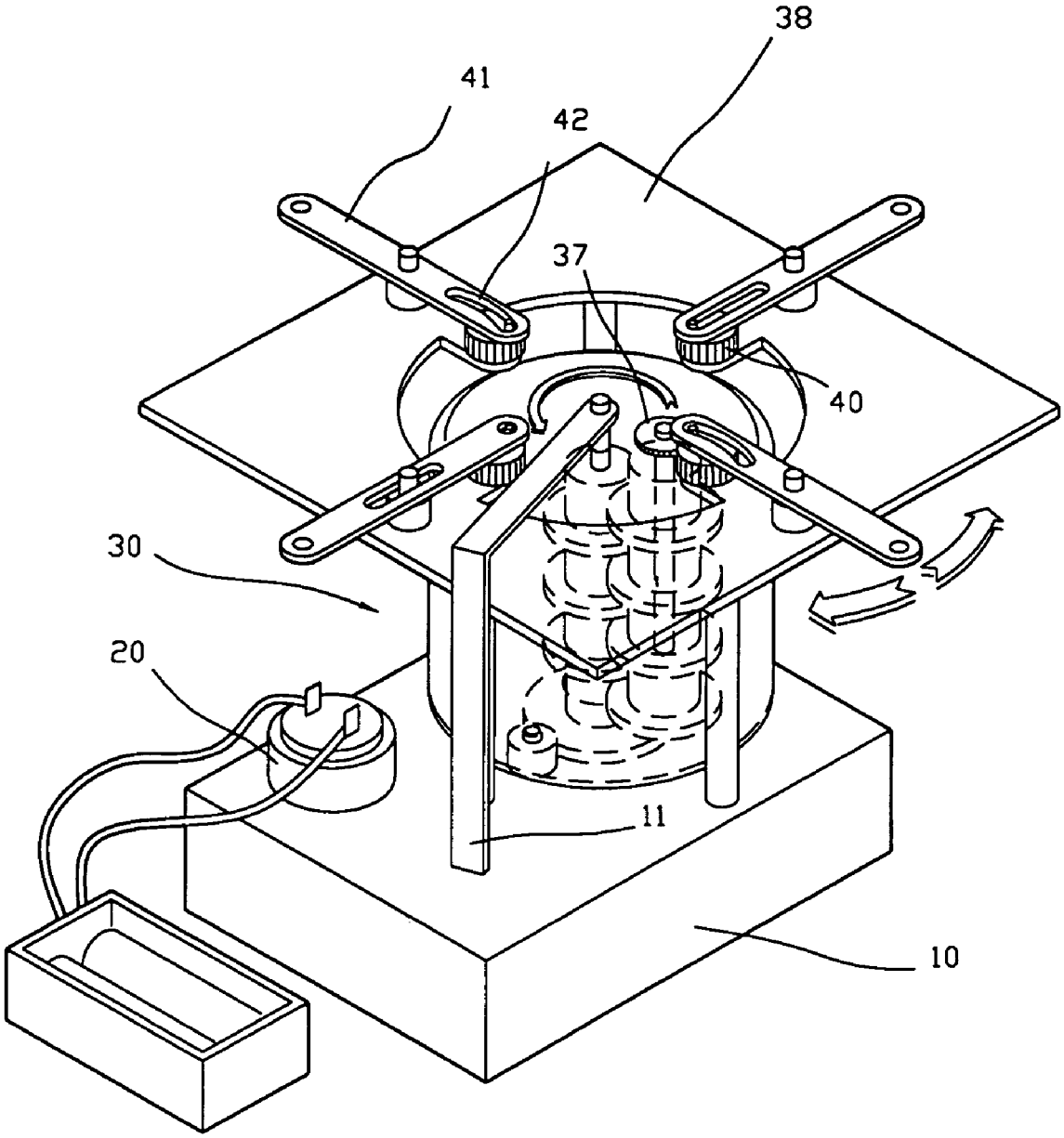
FIG. 4 is a perspective view showing the movement of the various parts of the actuation device of FIG. 1.
Figure 5:
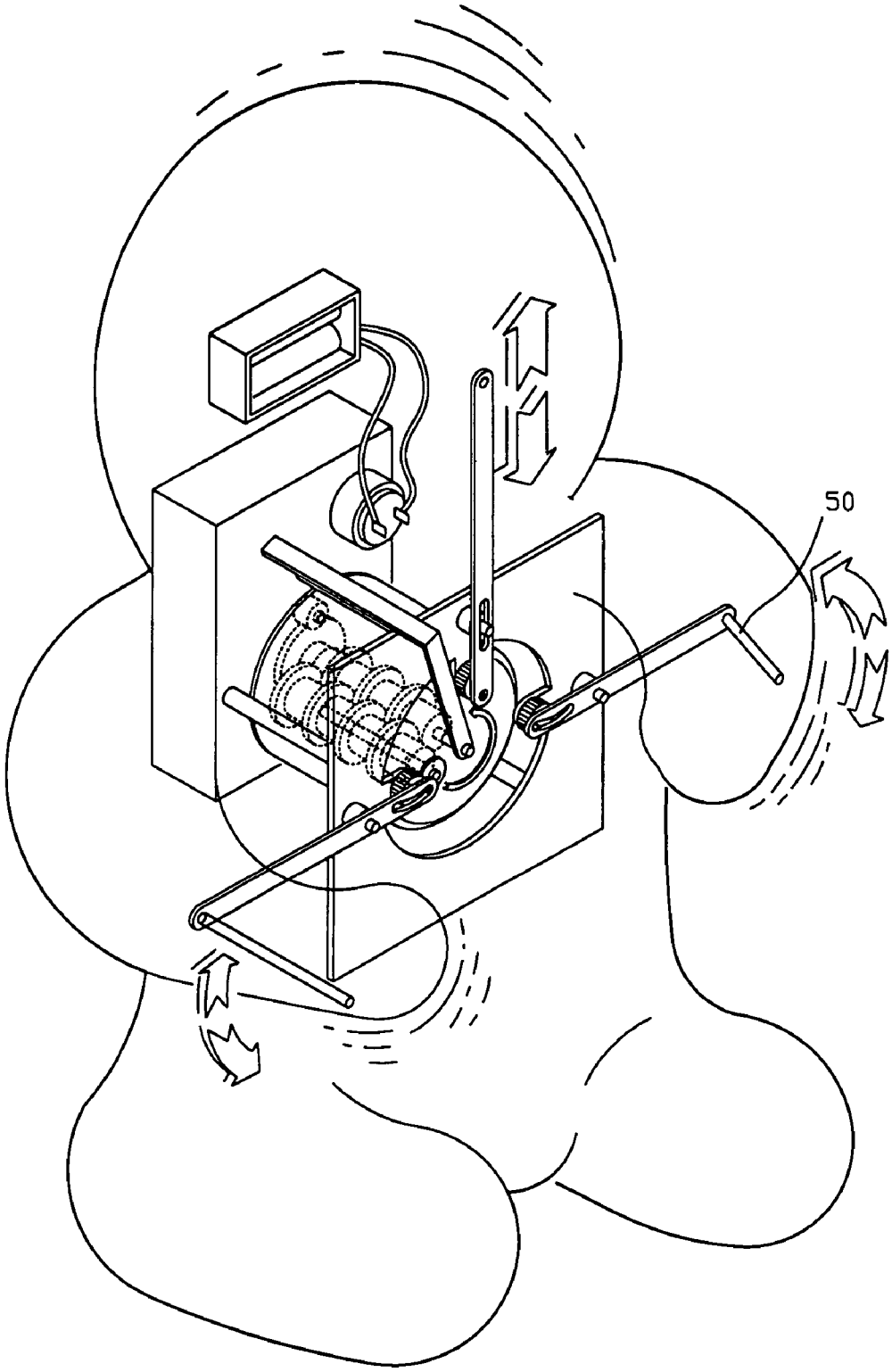
FIG. 5 is a perspective view showing the actuation device of FIG. 1 housed in an action doll.

As shown in FIGS. 1 to 5, the actuation device according to an embodiment of the present invention contains a base member 10, a motor 20, a gear assembly 30, a fixed gear 37, eccentric gears 40, connecting rods 41, and a distribution plate 38.

The motor 20 is installed on the base member 10, interacting with the gear assembly 30 via a gear 21 of the motor 20 and a reduction gear 22. The gear assembly 30, located on top of the base member 10, has a fixed axle 31 penetrating through the center supported at one end by an L-shaped outrigger 11 extended from the top surface of the base member 10. The fixed axle 31 is threaded through a number of movable speed-changing gears 32 and a fixed speed-changing gear 33. The gear assembly 30 also has a spinning axle 34 threading through a number of movable speed-changing gears 35 and a fixed speed-changing gear 36. The spinning axle 34 is located on top of and close to the rim of the fixed speed-changing gear 33. The gears 35 and 36 on the spinning axle 34 and the gears 32 on the fixed axle 31 are configured such that they are interleaved and interact with the fixed axle 31 and the spinning axle 34 respectively. The fixed gear 37 is located on the top end of the spinning axle 34, and is within a central opening of the distribution plate 38 positioned at the same height as the fixed gear 37. The eccentric gears 40 are positioned around the circumference of the central opening on top of the distribution plate 38. The axles of the eccentric gears 40 are joined to the ends of the connecting rods 41, whose other ends are joined to the rods 50 linked to the movable parts of a toy.

When the motor 20 is activated, the gear assembly 30 is engaged by the motor 20 via the gears 21 and 22. The gears along the fixed axle 31 are spun, which in turn causes the spinning axle 34 and, thereby, the fixed gear 37 to rotate around the fixed axle 31 within the central opening of the distribution plate 38. When the fixed gear 37 is rotated and gets into contact with the eccentric gears 40 sequentially and periodically, each of the eccentric gears 40 spins eccentrically, causing the joined connecting rod 41 to swing. The movable parts of the toy are thereby actuated by the rods 50 and the connecting rods 41 continuously and periodically.

Along each of the connecting rods 41, there is a groove 42 housing the axle of the corresponding eccentric gear 40, allowing the axle of the eccentric gear 40 to move relatively to the connecting rod 41 inside the groove 42. As the eccentric gears 40 are spun, the shapes of the grooves 42 determine how the connecting rods 41 (and thereby the rods 50) swing. The shapes of the grooves 42 can therefore be designed in accordance with the outlook and the desired actuation of the toy. The eccentric gears 40 are arranged along the rotational path of the fixed gear 37 as it rotates around the fixed axle 31. In the present embodiment, four eccentric gears 40 are provided. In alternative embodiments, additional eccentric gears 40 can be provided to actuate more parts of the toy to move more lively. Additionally, in alternative embodiments, additional spinning axles 34 and fixed gears 37 can be provided so that shorter period of parts movement and simultaneous movement of multiple parts of the toy can be achieved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An actuation device for a self-acting toy comprising:

a base member at the bottom of said actuation device for supporting the components of said actuation device;

a motor;

a gear assembly having a fixed axle in the center and a spinning axle parallel to said fixed axle; each of said fixed axle and said spinning axle threading through a plurality of gears; said gears of said fixed axle interacting with said gears of said spinning axle so that, when said fixed axle is driven to spin by said motor, said spinning axle is rotated around said fixed axle;

a fixed gear located on the top end of said spinning axle and rotating around said fixed axle along with said spinning axle;

a distribution plate provided at the same height of said fixed gear, said distribution plate having a central opening allowing said fixed gear to rotate within said central opening;

an eccentric gear on top of said distribution plate adjacent to the circumference of said central opening; and a connecting rod whose one end is joined to the axle of said eccentric gear and whose other end is joined to a movable part of said toy;

wherein, when said fixed gear is driven by said spinning axle which in turn is driven by said motor to move in a path around said fixed axle within said central opening, said fixed gear gets into contact with said eccentric gear, which in turn causes said connecting rod to swing.

2. The actuation device according to claim 1, wherein a groove is provided along said connecting rod, said groove houses the axle of said eccentric gear, and, when said eccentric gear is spun, said connecting rod is moved relatively to the axle of said eccentric gear.

3. The actuation device according to claim 1, further comprising additional pairs of said eccentric gears and said connecting rods provided along the rotational path of said fixed gear.

4. The actuation device according to claim 1, further comprising additional said spinning axles and said fixed gears so that shorter period of parts movement and simultaneous movement of multiple parts of said toy are achieved.

* * * * *